US009770812B2

(12) United States Patent
Jefferson

(10) Patent No.: US 9,770,812 B2
(45) Date of Patent: Sep. 26, 2017

(54) TOOL

(71) Applicant: Bryan Albert Jefferson, Herne Hill (AU)

(72) Inventor: Bryan Albert Jefferson, Herne Hill (AU)

( * ) Notice: Subject to any disclaimer, the term of this patent is extended or adjusted under 35 U.S.C. 154(b) by 77 days.

(21) Appl. No.: 14/757,436

(22) Filed: Dec. 23, 2015

(65) Prior Publication Data

US 2016/0114468 A1 Apr. 28, 2016

Related U.S. Application Data

(63) Continuation-in-part of application No. PCT/AU2015/000115, filed on Feb. 27, 2015.

(30) Foreign Application Priority Data

Mar. 7, 2014 (AU) ..... 2014900789

(51) Int. Cl.

| | |
|---|---|
| ***B25B 13/50*** | (2006.01) |
| ***B25B 13/06*** | (2006.01) |
| ***B25B 13/48*** | (2006.01) |
| ***B25B 13/02*** | (2006.01) |

(52) U.S. Cl.

CPC ..... *B25B 13/5033* (2013.01); *B25B 13/02* (2013.01); *B25B 13/06* (2013.01); *B25B 13/481* (2013.01); *B25B 13/5091* (2013.01)

(58) Field of Classification Search

CPC ..... B25B 13/5033; B25B 13/5091; B25B 13/481; B25B 13/02; B25B 13/06; B25B 13/48

See application file for complete search history.

(56) References Cited

U.S. PATENT DOCUMENTS 3,837,244 A * 9/1974 Schera, Jr. ..... B25B 23/105 81/64
5,455,997 A * 10/1995 Nasiell ..... B25B 13/481 29/456
5,572,913 A * 11/1996 Nasiell ..... B25B 13/481 81/177.6

(Continued)

OTHER PUBLICATIONS

International Search Report and Written Opinion issued for International Application No. PCT/US2015/0000115 dated Apr. 1, 2015 (14 pages).

*Primary Examiner* — David B Thomas

(74) *Attorney, Agent, or Firm* — Rothwell, Figg, Ernst & Manbeck, P.C.

(57) ABSTRACT

The inventions relates to a tool 10 that is adapted to loosen or fasten connector nuts located in areas of reduced space. The tool 10 is particularly useful because it allows manipulating basin nuts 40 located between the lower portion of the basing and piping that provides water to the faucets that are attached to the basin via the nut. The tool comprising a body having a first section adapted to receive the fastening means and a second section adapted to receive the torque, the first section and the second section being adapted for attachment to each other to transfer the torque to the first section, wherein the first section is adapted to allow piping to be located adjacent the second section during use of the tool to allow the first section to receive the fastening means. The tool may be configured as a socket. The invention also relates to a kit including the sockets.

21 Claims, 6 Drawing Sheets

(56) References Cited

U.S. PATENT DOCUMENTS

| | | | | |
|---|---|---|---|---|
| 6,122,997 | A * | 9/2000 | Altura | B25B 13/48 81/119 |
| 6,314,845 | B1 * | 11/2001 | Wu | B23P 19/006 81/454 |
| 6,487,942 | B1 * | 12/2002 | Carter | A62C 31/28 81/367 |
| 6,725,747 | B2 * | 4/2004 | Erwin | B25B 13/06 81/124.2 |
| 7,802,499 | B2 * | 9/2010 | Stephens | B25B 13/065 81/124.2 |
| 2002/0194966 | A1 | 12/2002 | Elmore | |
| 2004/0035259 | A1 | 2/2004 | Erwin | |
| 2007/0256237 | A1 | 11/2007 | Mayer | |
| 2008/0066584 | A1 | 3/2008 | Vines | |
| 2012/0060654 | A1 * | 3/2012 | Swanson | B25B 13/06 81/125 |

* cited by examiner

TOOL

CROSS REFERENCE TO RELATED APPLICATION

This application is a continuation-in-part of International Application No. PCT/AU2015/000115, filed Feb. 27, 2015, which claims the benefit of Australian Patent Application No. 2014900789 filed on Mar. 7, 2014, the disclosures of which are incorporated herein in their entirety by reference.

TECHNICAL FIELD

The present invention relates to tools fastening or loosing nuts.

The invention has been devised particularly, although not necessarily solely, in relation to a wrench and socket for fastening or loosing nuts. More particularly, the invention relates to a basin wrench and socket.

BACKGROUND ART

The following discussion of the background art is intended to facilitate an understanding of the present invention only. The discussion is not an acknowledgement or admission that any of the material referred to is or was part of the common general knowledge as at the priority date of the application.

Replacing an old faucet is typically a cumbersome and time consuming task. This is particularly true in view that locking nuts that hold the old faucet to the basin need to be removed. Removal of the nuts can be cumbersome and time consuming because typically the basin nuts are frozen to the thread of the faucets due to corrosion or mineral buildup from years of water seepage.

Moreover, removal of the basin nuts can also be cumbersome because the nuts are located in areas of reduced space located in the lower portion of the basin. These areas of reduced space are formed due the bowl or bowls that are formed in the basins for holding of liquids for washing purpose.

Furthermore, in particular removal of spouts (see FIG. 5*b*) from basins can be a greater challenge than removing, for example, pillar taps. This is because typically water mixers include piping located below the nut to be removed. This piping restricts accessing the nut with conventional tools. Tools have been designed to remove basin nuts under these particular circumstances. For example, adjustable basin wrenches are available. However these wrenches are typically too bulky and; thus, in most cases these tools cannot be used.

It is against this background that the present invention has been developed.

SUMMARY OF INVENTION

According to a first aspect of the invention there is provided a tool for applying torque to a fastening means, the tool comprising a body having a first section adapted to receive the fastening means and a second section adapted to receive the torque, the first section and the second section being adapted for attachment to each other to transfer the torque to the first section, wherein the first section is adapted to allow piping to be located adjacent the second section during use of the tool to allow the first section to receive the fastening means.

Preferably, the first section comprises at least one means for gripping at least a portion of the fastening means for application of the torque thereto.

Preferably, the first section comprises at least one indentation for receiving a portion of a fastening means.

Preferably, the portion comprises a wing.

In a particular arrangement, the first section comprises first and second gripping means arranged in an opposite relationship with respect to each other to define two first clearances arranged in an opposite relationship with respect to each other, the clearances permitting, during use of the tool, piping to traverse the first section for location of the piping adjacent to the second section.

Preferably, the first and second section are arranged in a spaced apart relationship with respect to each other to define a second clearance between the first section and the second section to allow rotary movement of the tool during application of the torque to the fastening means.

In a particular arrangement, the distance between the first section and the second section (that define the second clearance) has a length of between about 34 to 54 mm.

Preferably, the tool further comprises a third section for joining the first and second section together.

Preferably, the third section is of reduced width with respect to the gripping means.

Preferably, the third section comprises reinforcement means.

Preferably, the reinforcement means comprises a plurality of ribs spaced apart with respect to each other.

Preferably, the third section is of variable size to allow varying of the distance between first section and the second section.

Preferably, the third section comprises two centre sections opposite with respect to each other to define the first two clearances.

In a particular arrangement, each centre section has a width of between about 9.6 mm to 15.5 mm defining the two first clearances.

In a particular arrangement, the two first clearances have a size of about 26.1 mm to about 32.4 mm.

In other arrangements, the two first clearances taper as they extend from the first section to the second section, their size being between about 26.1 to 32 mm at the first section and reducing to 24.6 to 30.6 mm at the second section.

Preferably, the second section is adapted to receive a handle to allow application of torque to the second section.

Preferably, the first, second and third section are configured to define a socket.

Preferably, the socket is adapted to receive the handle

Preferably, the handle is releasably attached to the socket.

Preferably, the handle comprises a plurality of bars, the bars being pivotally attached with respect to each other.

Preferably, the handle is of variable length.

Preferably, the fastening means comprises a nut for fastening a faucet.

Preferably, the nut comprises a hexagonal nut.

Preferably, the gripping means are adapted to receive a nut

Preferably, each gripping means comprise three sides.

Preferably, the gripping means comprises a centre section and two side sections extending diagonally outward from the centre section defining a substantially U-shaped section.

Preferably, the centre section of each gripping means comprises an indentation for receiving a portion of the nut. This arrangement is particularly advantageous because it allows fastening or loosening a faucet stem retention nut of the type having wings.

Preferably, the portion of the nut comprises a wing of the nut.

In a particular arrangement, the gripping means define a hexagonal nut.

According to a second aspect of the invention there is provided a socket for applying torque to a faucet nut located between a surface and a piping, the socket comprising a first section adapted to receive the nut and a second section adapted to receive the torque, the first section and the second section being attached to each other to transfer the torque to the first section, wherein the first section is adapted to allow the piping to be located adjacent the second section during use of the tool to allow the first section to receive the nut for applying torque to the nut.

Preferably, the first section comprises first and second gripping means arranged in an opposite relationship with respect to each other to define two first clearances arranged in an opposite relationship with respect to each other, the clearances permitting, during use of the socket, the piping to traverse the first section for location of the piping adjacent to the second section.

Preferably, the tool further comprises a third section for joining the first and second section together.

Preferably, the third section is of reduced width with respect to the gripping means.

Preferably, the second section is adapted to releasably receive a handle.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENT(S)

FIGS. 1 to 4 show a first arrangement of a tool 10 in accordance with an embodiment of the invention. The tool 10 is adapted to loosen or fasten connector nuts 40 located in areas of reduced space. The tool 10 is particularly useful because it allows manipulating basin nuts 40 located between the lower portion of the basing and piping that provides water to the faucets that are attached to the basin via the nut 40—see FIGS. 5*a* and 5*b* and FIGS. 7*a* to 7*e*.

Figure 1:
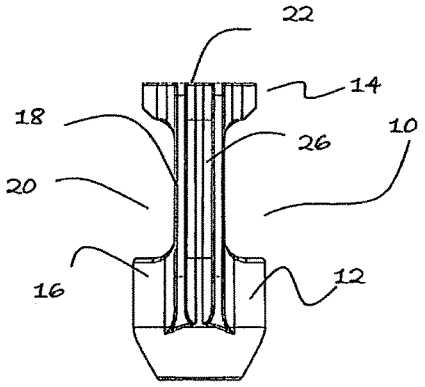
FIG. 1 is a front view of a first arrangement of a tool in accordance with an embodiment of the invention.

FIG. 1 shows a side view of the tool 10. The tool 10 comprises a body 12. The body 12 comprises a distal section 14 (the first section) and a proximal section 16 (the second section). The distal section 14 and the proximal section 16 are joined together via two centre sections 18 (the third section) opposite with respect to each other to define clearances 24*a* and 24*b* (the first clearances)—see for example 24*b*. The width of each centre section 18 defines the size of the clearances 24*a* and 24*b*. As will be explained at a later stage, the particular size of the clearances 24*a* and 24*b* facilitates fastening and loosening of the nuts 40.

The fact that the distal section 14 is separated from the proximal section 16 defines a clearance 20 (the second clearance) between the distal and proximal section 14 and 16. The clearance 20 is adapted to receive the piping 28. As will be explained with reference to the method of operation of the tool 10, the clearance 20 allows rotation of the tool 10 during application of the torque to the connector nut 40 for loosening or fastening of the connector nut 40. In an arrangement, the clearance 20 may be about between 34 mm to 54 mm long.

Referring now to FIGS. 2*a* and 2*b* and FIGS. 3*a* and 3*b*, in the particular arrangement shown in the figures, the distal section 14 comprises a plurality of gripping means 22. The gripping means 22 are arranged in an opposite relationship with respect to each other to allow releasably grabbing a connector nut 40.

Figure 2A:
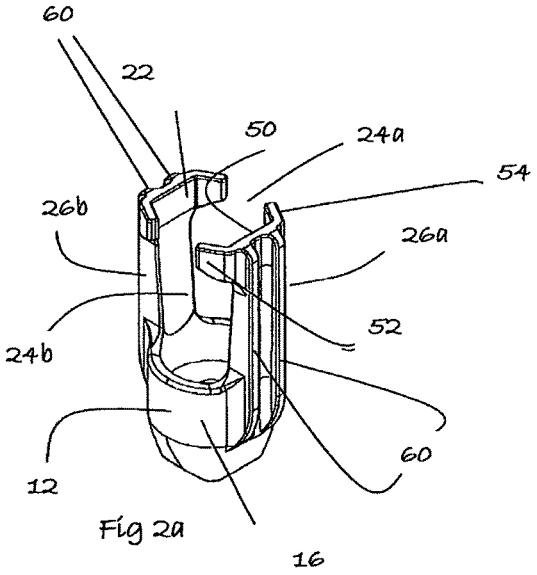
FIGS. 2*a* and 2*b* are perspective views of the tool shown in FIG. 1.
Figure 3A:
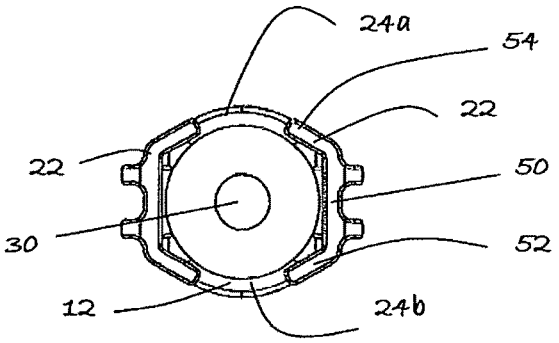
FIGS. 3*a* and 3*b* are respectively a top and a bottom view of the tool shown in FIG. 1.

Referring in particular to FIGS. 2*a* and 3*a*, each gripping means 22 are configured for releasably grabbing a connector nut 40. In the particular arrangement shown in the figures each gripping means 22 comprises a centre section 50 and two side sections 52 and 54. The side sections 52 and 54 extend diagonally outward from the centre section 50 defining a substantially U-shaped section—see FIG. 3*a*. This particular arrangement of the gripping means 22 is adapted to receive connector nuts 40 of a variety of different configurations such as, for example, hexagonal shaped nuts 40. In alternative arrangements of the present embodiments the gripping means 22 may be configured in such a manner that other type of nuts may be fastened or loosened with help of the present tool 10.

Further, the fact that the distal section 14 comprises a plurality of gripping means 22 that are opposite with respect to each other defines a plurality of first clearances 24*a* and 24*b*—see FIG. 3. As will be explained with reference to the method of operation of the tool 10, the first clearances 24 allows piping 28 to be located adjacent to the proximal section 16—see FIG. 5.

Further, the centre section 18 comprises a plurality of supports 26*a* and 26*b*. Each support 26 joins one of the gripping means 22 of the distal section 14 to the proximal section 16. In the particular arrangement shown in the figures, the supports 26 are of a reduced width with respect to the gripping means 22. As will be explained with reference to the method of operation of the tool 10, the reduced width of the supports 26 facilitates turning of the tool during manipulation (for example, loosening or fastening) of the nut.

Figure 2B:
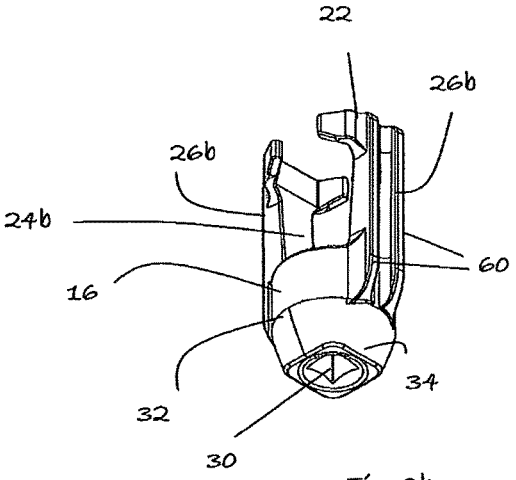
Figure 3B:
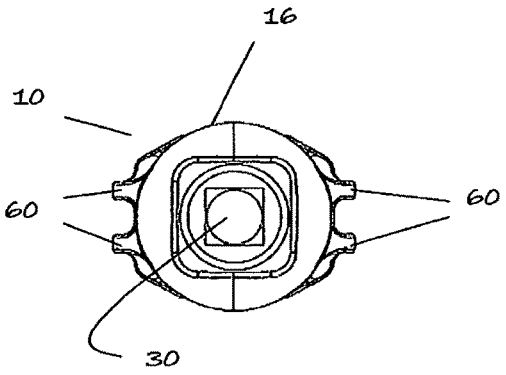
Figure 4:
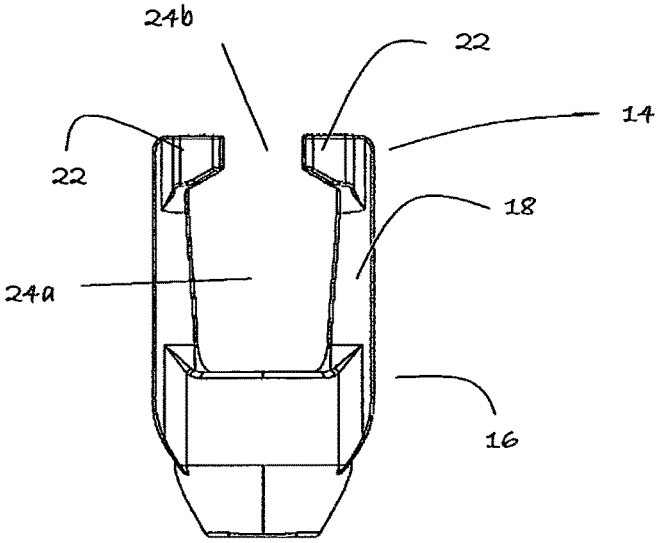
FIG. 4 is a side view of the tool shown in FIG. 1.

We refer now to FIGS. 2*b* and 3*b*.

It was mentioned that the tool 10 comprises a proximal section 16 to which the distal section 14 of the tool 10 is joined via the centre section 18. This proximal section 16 is adapted to receive torque for delivery to the distal section 14 during fastening or loosing of the nut 40. In a particular arrangement, the proximal section 16 comprises a first end 32 and a second end 34. The first end 32 is attached to the centre section 18 to which the distal section 14 is attached. The second end 34 is adapted for attachment of a tool to apply torque to the proximal section 16. As shown, in FIG. 2*b*, the second end 34 comprises an opening 30 adapted to receive, for example, a square fitting 56 (see FIGS. 6*a* and 6*b*) that is attached to a tool such as a handle or ratchet. In this manner, torque may be applied to the tool 10 for either loosening or fastening a nut 40 such as a basin nut 40.

Figure 6A:
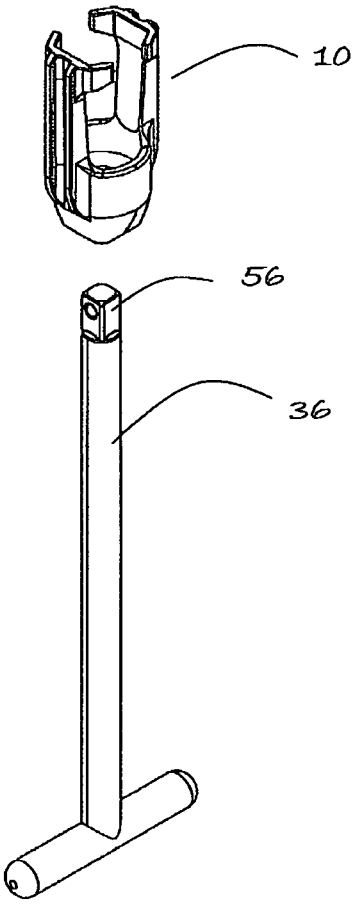
FIG. 6*a* is a perspective view of the tool shown in FIG. 1 prior attachment of a handle.
Figure 6B:
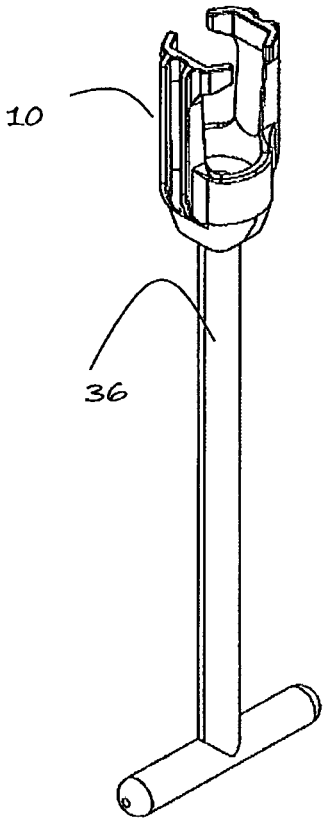
FIG. 6*b* is a perspective view of the tool shown in FIG. 1 having a handle attached thereto.

As an example, FIGS. 6*a* and 6*b* shows a tool 10 in accordance with a particular arrangement. In this particular arrangement, the tool 10 comprises a T-handle 36 attached thereto. The T-handle 36 may be of variable size and/or may include a plurality of bars pivotally attached to each other defining elbows to orient the handle 36 at different angles with respect to the longitudinal axis of the tool 10.

In an alternative arrangement, the tool 10 may be configured as a socket. The first end 32 of the socket is adapted to receive the distal section 14 of the tool 10 and the second end 34 is adapted to receive the square fitting 56 to allow releasably attaching the previously described T-handle 36. The socket may be adapted to receive a square fitting of a wrench such as, for example, a ratchet.

Figure 5A:
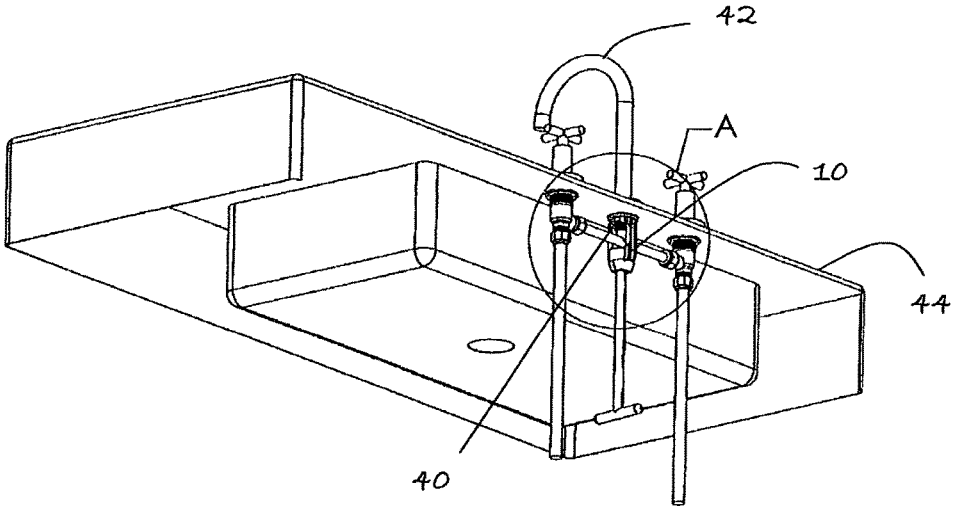
FIG. 5*a* is a perspective view of the tool shown in FIG. 1 in use.
Figure 5B:
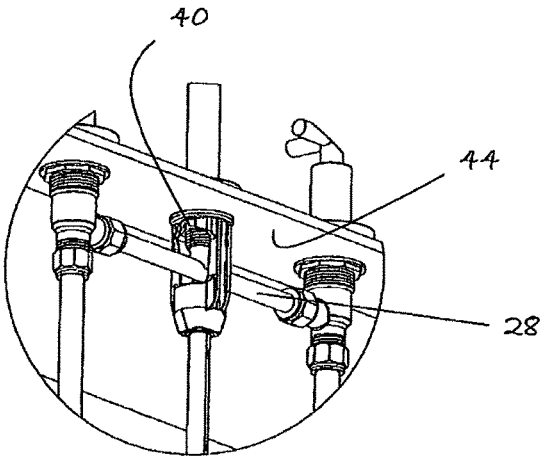
FIG. 5*b* is the detail A shown in FIG. 5*a;*

FIG. 5*a* shows the tool 10 in use. In this arrangement, the tool 10 is used for loosening or fastening of a nut 40 that attaches a faucet 42 to a countertop 44. As shown in FIG. 5*b*, the nut 40 is located between the countertop 44 and the piping 28. As can be appreciated from FIG. 5*b*, the piping 40 hinders accessing the nut 40 by a conventional tool, such as a conventional socket which are typically used for applying torque to nuts.

We refer now to FIGS. 7*a* to 7*e*.

Figure 7A:
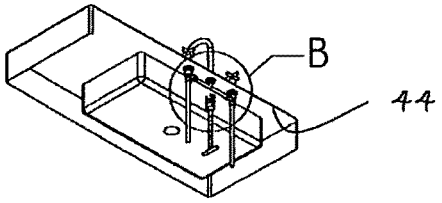
FIGS. 7*a* to 7*e* show the tool of FIG. 1 in use.
Figure 7B:
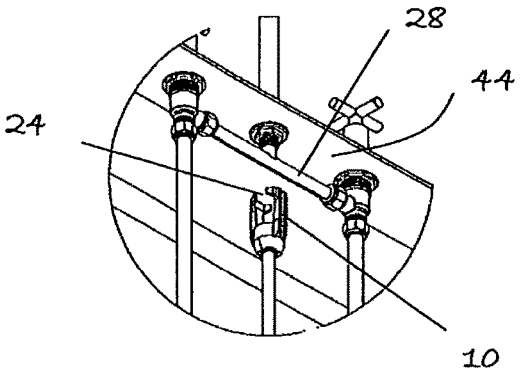
Figure 7C:
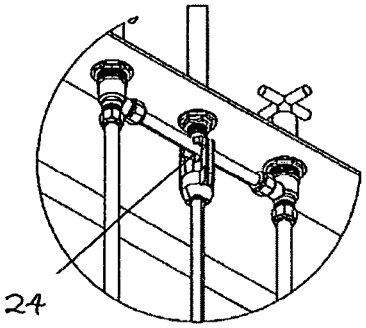
Figure 7D:
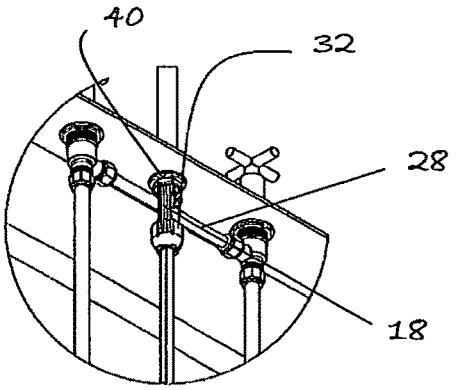

In operation, as shown in FIG. 7*b* the tool 10 is approached towards the lower portion of the counter top 44 such that the nut 40 may be located between the gripping means 22—see FIG. 7*d*. The nut 40 can be located between the gripping means 22 because the distal section 14 comprises the clearances 24 that allows the piping 28 to traverse the distal section 14 of the tool 10 to locate the piping 28 adjacent the first end 32 of the tool 10. At this stage, the user may apply torque to the nut 40 for either fastening or loosening of the nut 40 during attachment or detachment from the countertop 44. The tool 10 is able to rotate and thus applying the torque to the nut 40 due to fact that the centre section 18 is of a reduced width with respect to the gripping means 22 defining the clearances 24.

Figure 7E:
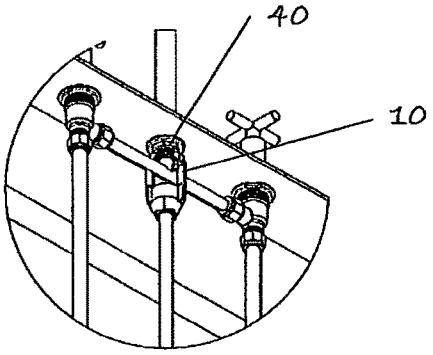

Referring to FIG. 7*e*, the nut 40 may be fastened or loosened by continually applying torque to the nut 40 using the tool 10. This is accomplished by (1) attaching the tool 10 to the nut 40 and turning the tool 10 until the centre sections 18 reaches the tubing 28 (see FIG. 7*e*), and (2) releasing the tool 10 from the nut 40 as shown in FIG. 7*e* and repeating step (1). For fastening or loosening the nut 40, these two steps may be continuously repeated until the nut 40 has been fastened or loosened.

We refer now back to FIG. 2. The particular arrangement shown in these figures show a plurality of ribs 60 spaced apart with respect to each other. The ribs 60 extend from the distal section 14 to the proximal section 16 of the tool 10. It is particularly advantageous that the toll comprises the ribs 60. This is because one of the advantages of the inclusion of the ribs 60 is that it reinforces the centre section 18. In this manner, the centre section 18 may be of relative small width.

Furthermore, it was mentioned earlier that the fact that the centre section 18 may be of a reduced width with respect to the gripping means 22 provides a plurality of clearances 24*a* and 24*b*. The size of the clearance 24*a* and 24*b* will determine the amount that the tool 10 may be turned during fastening or loosening of the nut 40. In accordance with the present embodiment of the invention, the width of the centre section 18 of a particular tool (in accordance with the present embodiment of the invention) may differ with respect to each other; in this manner, different tools 10 may be used for different faucets 42 differing in the type of tubing or the tubing arrangement located below the countertop 44.

In a particular arrangement, each centre section 18 has a width of about between 9.6 to 15.5 mm defining the two first clearances 24.

In a particular arrangement, the two first clearances have a size of about 26.1 mm to about 32.4 mm.

In other arrangements, the two first clearances taper as they extend from the first section to the second section, their size being between about 26.1 to 32.4 mm at the first section and reducing to 24.6 to 30.6 mm at the second section.

In a particular arrangement, the distance between the distal section 14 and the proximal section 16 (that define the second clearance 20) has a length between about 34 mm to 54 mm.

Furthermore, the above described arrangement of the tool 10 is configured for use in connection to conventional nuts such as hexagonal nuts. However, the tool 10 may be configured to accept connector nuts 40 of varied configurations and sizes.

Figure 9B:
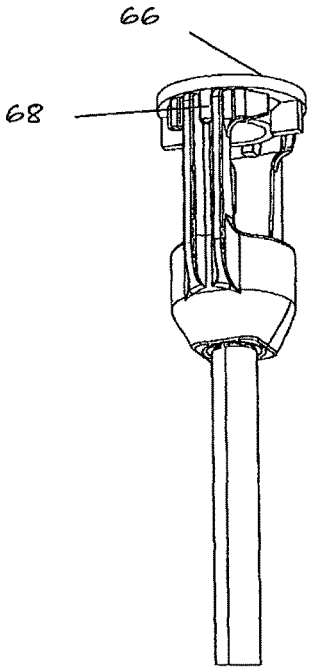
FIGS. 9*a* and 9*b* are perspective views of the tool shown in FIG. 8 in use.
Figure 9A:
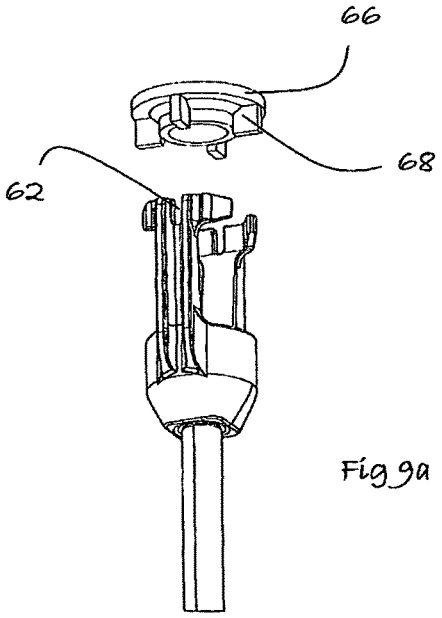

For example, in a second arrangement of the tool 10 may be configured for receiving a faucet stem retention nut 66 of the type having wings 68 to facilitate rotation as shown in FIG. 9*a*.

Figure 8:
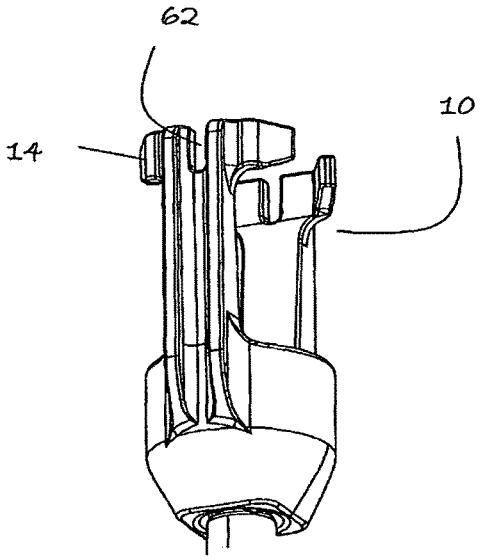
FIG. 8 shows of a second arrangement of a tool in accordance with the present embodiment of the invention.

FIG. 8 shows this particular second arrangement of the tool 10. As shown in FIG. 8, the tool 10 in accordance the second arrangement comprises an indentation 62 extending into the distal end 14 of the tool 10. The indentation 62 is adapted to receive the wings 68—see FIG. 9*b*.

Modifications and variations as would be apparent to a skilled addressee are deemed to be within the scope of the present invention.

Further, it should be appreciated that the scope of the invention is not limited to the scope of the embodiments disclosed. By way of example, the arrangement of the figures shows the plurality of gripping means 22 defining a hexagonal head adapted to apply torque to a hexagonal nut. However, the distal section may be configured to define any of shape so as to receive any type of nut.

Moreover, the centre section 18 has been described as having a particular fixed length. However, alternative arrangement of the tool 10, may include centre sections 18 of different fixed lengths. In a further particular arrangement, the centre section 18 of a particular tool may be adapted for varying is particular length.

In an arrangement, a particular embodiment of the invention may provide a kit comprising a plurality of sockets having heads of different shapes so as to loosen or fasten different type of nuts. For example, in an alternative arrangement of the present embodiment of the invention may include a double hex design such as a 12 pointed socket. In a particular arrangement, two of the points may be removed to allow a greater range of rotary movement during fastening or loosening of the nut 40.

Also, the sockets included in the kit may include centre sections 18 of different lengths and different width. This kit is particular useful because it allows handling a plurality of different configurations of faucets and nuts attached to different type of countertops 44.

In further embodiment of the invention there may be provided a tool 10 wherein the length of the centre section 18 may be variable to accommodate the various requirements depending on the type of applications for which the tool 10 is to be used.

Furthermore, the distal section 14 may be releasably attached to the proximal section 16. For example, in a the particular arrangement, the toll 10 may incorporate proximal sections that are adapted to releasably attaching the centre section so as to releasably attaching the distal section 14 to the proximal section 16.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The invention claimed is:

1. A tool for applying torque to a fastening means, the tool comprising a body having a first section being adapted for receiving at least a portion of the fastening means for application of the torque to the fastening means, a second section adapted to receive the torque, and a third section for joining the first and second section to transfer the torque to the first section, the first section comprising first and second gripping means arranged in an opposite relationship with respect to each other, and the third section comprising two centre sections opposite with respect to each other, wherein each centre sections are of reduced width with respect to the gripping means to define a plurality of clearances.

2. A tool according to claim 1 wherein the first section comprises at least one indentation for receiving a portion of a fastening means.

3. A tool according to claim 2 wherein the portion comprises a wing of the fastening means.

4. A tool according to claim 1 wherein the distance between the first section and the second section has a length of between about 34 to 54 mm.

5. A tool according to claim 1 wherein the third section comprises reinforcement means.

6. A tool according to claim 5 wherein the reinforcement means comprises a plurality of ribs spaced apart with respect to each other.

7. A tool according to claim 1 wherein the third section is of variable size to allow varying of the distance between first section and the second section.

8. A tool according to claim 1 wherein each centre section has a width of between 9.6 mm to 15.5 mm defining the two first clearances, the two first clearances having a size of about 26.1 mm to about 32.4 mm.

9. A tool according to claim 8 wherein the plurality of clearances taper as they extend from the first section to the second section.

10. A tool according to claim 9 wherein size of the clearances is between about 26.1 to 32 mm at the first section and reducing to 24.6 to 30.6 mm at the second section.

11. A tool according to claim 1 wherein the second section is adapted to receive a handle to allow application of torque to the second section.

12. A tool according to claim 11 wherein the handle comprises a plurality of bars, the bars being pivotally attached with respect to each other.

13. A tool according to claim 11 wherein the handle is of variable length.

14. A tool according to claim 1 wherein the fastening means comprises a nut for fastening a faucet.

15. A tool according to claim 14 wherein the nut comprises a hexagonal nut.

16. A tool according to claim 1 wherein each gripping means comprises three sides.

17. A tool according to claim 16 wherein the three sides comprise a centre section and two side sections extending diagonally outward from the centre section defining a substantially U-shaped section.

18. A tool according to claim 1 wherein the gripping means define a hexagonal head.

19. A socket for applying torque to a faucet nut located between a surface and a piping, the socket comprising a first section for application of the torque to the faucet nut, a second section adapted to receive the torque, and a third section for joining the first and second section to transfer the torque to the first section, the first section comprising first and second gripping means arranged in an opposite relationship with respect to each other and the third section comprising two centre sections opposite with respect to each other, wherein the centre sections are of a reduced width with respect to the gripping means to define clearances.

20. A socket according to claim 19 wherein the second section is adapted to releasably receive a handle.

21. A kit comprising a plurality of sockets as defined in claim 19.

* * * * *